US005329894A

United States Patent [19]

Phoenix et al.

[11] Patent Number: 5,329,894

[45] Date of Patent: Jul. 19, 1994

[54] VARIABLE VALVE TIMING

[76] Inventors: John B. Phoenix; Lancelot Phoenix, both of 92 Leopold Ave., Handsworth Wood, Birmingham B20 1ET, England

[21] Appl. No.: 910,183

[22] PCT Filed: Oct. 31, 1991

[86] PCT No.: PCT/GB91/01916

§ 371 Date: Jul. 17, 1992

§ 102(e) Date: Jul. 17, 1992

[87] PCT Pub. No.: WO92/09793

PCT Pub. Date: Jun. 11, 1992

[30] Foreign Application Priority Data

Nov. 27, 1990 [GB] United Kingdom ..... 9025739

[51] Int. Cl.[5] ..... F01L 1/34

[52] U.S. Cl. ..... 123/90.17; 123/90.15; 123/90.31; 464/1; 464/2

[58] Field of Search ..... 123/90.15, 90.17, 90.31; 464/1, 2, 160

[56] References Cited

U.S. PATENT DOCUMENTS

| | | | |
|---|---|---|---|
| 4,305,352 | 12/1981 | Oshima et al. | 123/90.15 |
| 4,577,598 | 3/1986 | Ma | 123/90.18 |
| 4,747,375 | 5/1988 | Williams | 123/90.15 |
| 5,002,023 | 3/1991 | Butterfield et al. | 123/90.17 |
| 5,046,460 | 9/1991 | Butterfield et al. | 123/90.17 |
| 5,056,477 | 10/1991 | Linder et al. | 123/90.17 |
| 5,056,478 | 10/1991 | Ma | 123/90.17 |

FOREIGN PATENT DOCUMENTS

| | | |
|---|---|---|
| 0063038 | 10/1982 | European Pat. Off. . |
| 3234640A1 | 3/1984 | Fed. Rep. of Germany . |
| 3631733A1 | 3/1988 | Fed. Rep. of Germany . |
| 2209061A | 4/1989 | United Kingdom . |

OTHER PUBLICATIONS

The Institution of Mechanical Engineers, vol. 186, 23/72, Proceedings 1972 "Variable Valve-Timing Unit Suitable for Internal Combustion Engines" (con't) G. E. Roe, Ma, PhD.

*Primary Examiner*—Willis R. Wolfe
*Assistant Examiner*—Weilun Lo
*Attorney, Agent, or Firm*—Nixon & Vanderhye

[57] ABSTRACT

A means of varying both the opening and closing angle of internal combustion engine cam-operated valves by means of a mechanism which responds to the torque applied to the camshaft by the valve springs in such a way that the opening angle of the valves is retarded and the closing angle advanced and in which a means of inhibiting this operation can be incorporated.

18 Claims, 2 Drawing Sheets

VARIABLE VALVE TIMING

BACKGROUND OF THE INVENTION

1. Field of the Invention

This invention relates to variable valve timing for an internal combustion engine.

2. Discussion of Prior Art

In an internal combustion engine of the four-stroke (Otto cycle) type the phase of the engine cycle during which the inlet and exhaust valves are open is usually referred to as valve timing and is quoted as the opening and closing angles for both the inlet and exhaust valves before or after the point at which the piston reaches "top dead center" (TDC) or "bottom dead center" (BDC). In a conventional engine these angles are fixed and do not vary over the entire engine speed and load range.

The fixed valve timing is a compromise setting over most of the engine operating range because the dynamic behavior of the gas flows in the cylinder and through the valves varies considerably over the entire range. For this reason the fixed valve timing can only be correct for some required engine performance characteristic (eg. minimum exhaust emissions, maximum power, lowest fuel consumption) at one particular engine speed and load situation and over the rest of the range poorer performance must be accepted.

This behavior of the fixed-valve-timing internal combustion engine has been known almost since its invention but the simplicity of fixed valve timing has led to its retention, with individual engine designs being 8 compromise aimed at some particular performance characteristic in which some desirable characteristics are sacrificed for others; for example an engine design might aim for high output power at high speed at the expense of low speed tractability.

There is a great deal of published information and patents on means of varying the valve timing of an engine. The methods that are described in these vary widely but one group of mechanisms change the valve timing by changing the phase of the camshaft relative to the crankshaft. All of these mechanisms have a source of power separate from the camshaft to effect this variation in phase.

SUMMARY OF THE INVENTION

According to the present invention there is provided an internal combustion engine valve timing system in which the camshaft is driven by means of a mechanism which can permit a limited change in the phase relationship between the engine crankshaft and the camshaft and in which the phase change takes the form of an angular displacement which is compliantly constrained about some nominal angle in such a way that the torque reaction from the camshaft operating the valves results in a change in the instantaneous phase displacement in some desired manner.

DETAILED DESCRIPTION OF PREFERRED EMBODIMENTS

Figure 1:
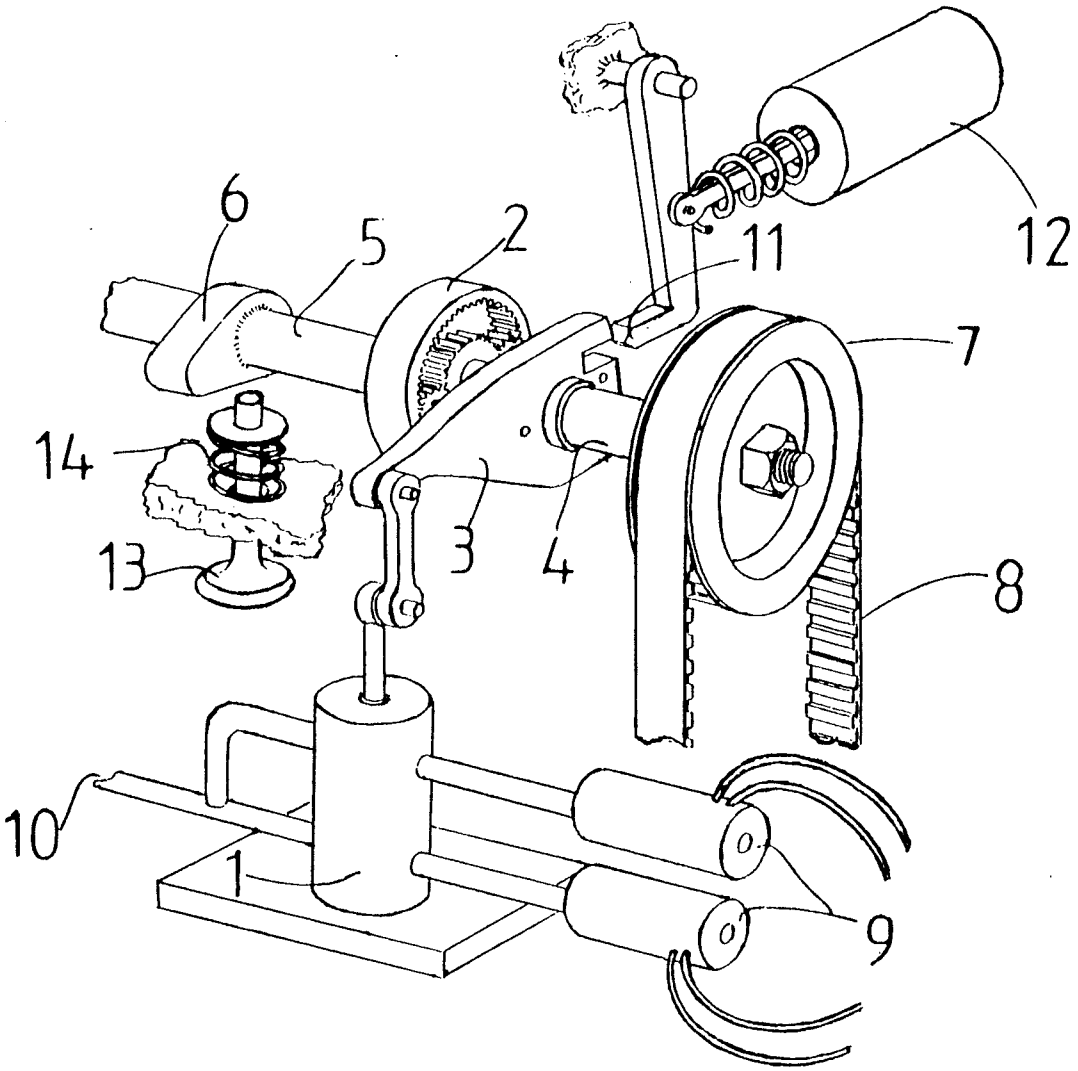
FIG. 1 is a pictorial representation of one example of the invention in which the camshaft drive is passed through an epicyclic differential mechanism the reaction-member of which is attached to a device which permits limited movement of the reaction-member and, in addition, a reaction-member locking mechanism is shown.

In FIG. 1 a camshaft 5 is driven by the engine crankshaft by means of toothed belt 8 and pulley 7 through the input shaft 4. Interposed in this drive is an epicyclic differential-gear 2, the planet gears of which are supported on shafts protruding from the reaction-member 3. The sun gear of the differential 2 is driven by the input shaft 4 which passes through a bearing in the reaction-member 3. Rotation of the sun gear with the input shaft 4 causes the annulus of the differential 2 to rotate in the opposite sense to the input shaft 4 at a speed ratio depending on the number of teeth on the sun gear and the annulus. The torque required to drive the camshaft would cause the reaction-member 3 to rotate in the same sense as the sun gear and this rotation is prevented by the spring-loaded member 1. This spring-loaded member 1 is equipped with damping means which may be varied electromagnetically with solenoid valves 9 and has an oil supply 10 from the engine lubrication system.

Cam 6 may be one of several cams on camshaft 5. Cam 6 when operating on valve 13 experiences a torque from the force applied by the valve-spring 14 in a sense which opposes the normal motion of the cam when depressing the valve 13 but once the valve 13 has passed maximum depression the sense of the torque changes so that the torque now assists the normal motion of the cam 6. The alternating sense of the torque on the cam 6 causes an unlocked reaction-member 3 to rock about input shaft 4. The angular extent of this rocking is limited by the spring-loaded member 1.

The effect of this rocking of reaction-member 3 is to retard the opening of valve 13 and to advance the closing of valve 13. By suitable choice of springs within the spring-loaded member 1 and adjustment of the damping by the solenoid valves 9 the degree of advance and retard of the valve timing can be controlled. Pawl 11 is spring-loaded into the slot in reaction-member 3 to prevent the- rocking motion of reaction-member 3 when fixed timing operation of the camshaft is required. An actuator 12 withdraws the pawl 11 from the slot when variable valve timing is required.

At high engine speeds gas dynamics result in scavenging of the cylinder as exhaust gasses are expelled, and require the inlet valve to open early to take advantage of the depression in the cylinder which can then accept combustible charge before the piston starts to descend. Similarly, after the piston reaches bottom dead center and starts to ascend the gas charge continues to flow into the cylinder because of gas inertia, and it is advantageous to close the inlet valve after the piston has progressed some way up the cylinder.

At low engine speeds the gas inertia effects are very much reduced and, both, to prevent the exhaust gas blowing back into the inlet manifold when the piston is approaching TDC and to prevent the combustible charge blowing back into the inlet manifold when the piston starts to ascend after BDC, it is desirable to open the inlet valve later and close it earlier than is the case at high engine speeds. Similar considerations apply to the exhaust valve. The example shown, therefore, shows the variable valve timing operating for the low speed situation.

Figure 2:
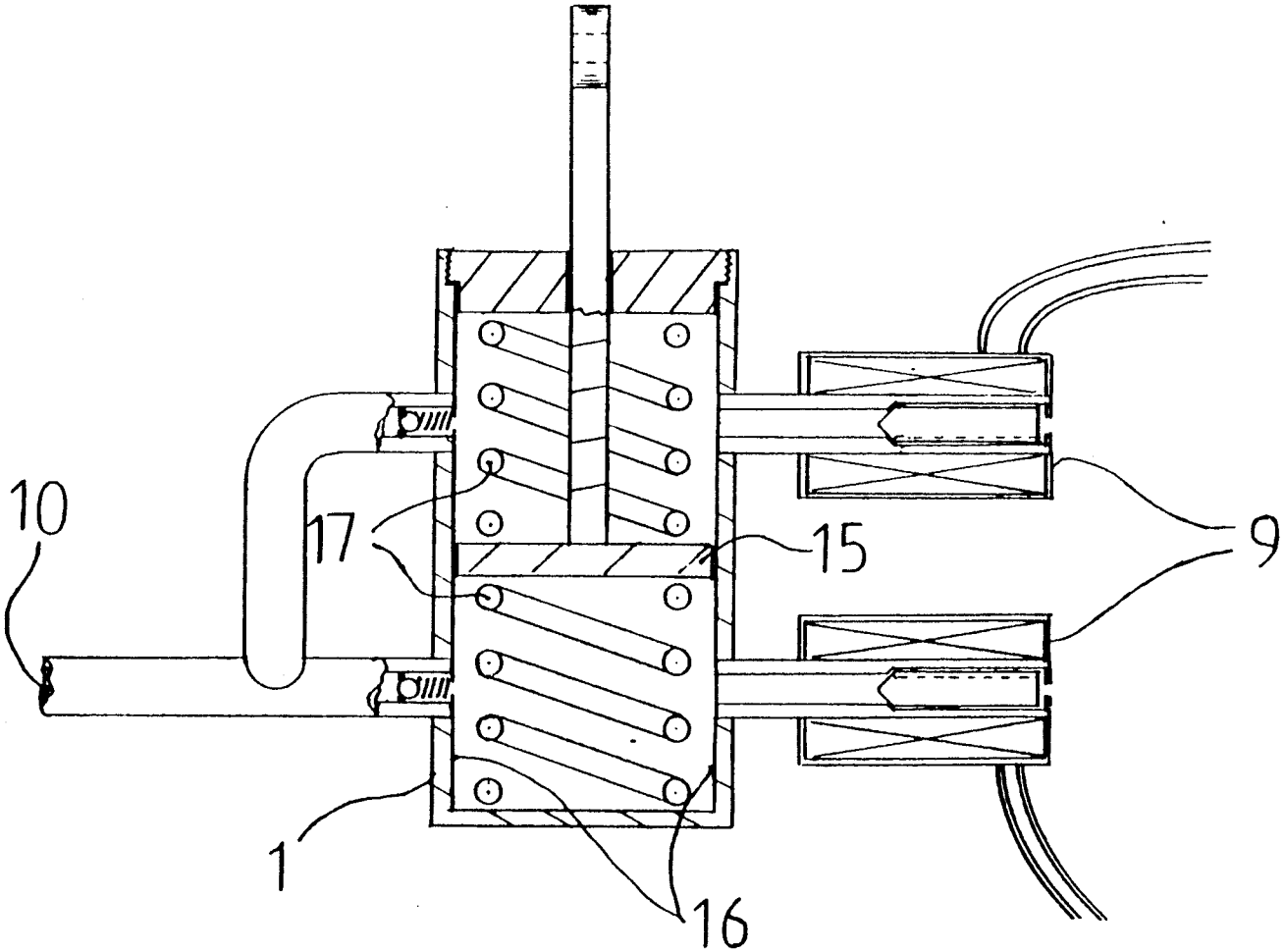
FIG. 2 shows a particular example of the means of providing compliance and damping in the reaction-member support.

FIG. 2 shows one arrangement of the spring-loaded member 1 in which two pre-loaded springs 17 determine the position of a piston 15 in a cylinder 16 in the absence of any external force. The springs 17 provide a restoring force to piston 15 when it is deflected from the neutral position by the camshaft reaction torque acting through the reaction-member 3 shown in FIG. 1. In the absence of any damping, the reaction-member 3 would rock through an angle determined by the force of the valve-spring 14 acting on the cam 6 and the restoring force provided by the springs 17, therefore, the angle of advance and retard of the camshaft by comparison with its fixed timing position would depend on the relationship of the spring rates of the spring 14 and the springs 17 and on the dimensions of the mechanical components.

Suitable choices of spring rates would result in some substantially fixed advance and retard angles appropriate to very low speed engine operation. However, as engine speed increases, it is desirable for the engine to approach a fixed valve timing appropriate to the high speed gas dynamics situation.

To allow the valve timing to be changed from the situation in which the timing depends on the selection of spring rates, progressive damping can be applied to the piston 15 by restricting the oil flow through solenoid valves 9 which urge plungers against valve Beats to provide a restriction to oil flow and at some appropriate speed pawl 11 can be engaged to lock the reaction-member 3 and fix the valve timing.

The damping restriction can be applied differentially, if desired, to affect the mean position about which the piston oscillates. In this way some measure of independent control of the opening and closing times of valve 13 can be effected.

It will be understood that various mechanisms may be devised which would provide the compliantly restrained phase-change without affecting the novel aspects of the invention.

We claim:

1. An internal combustion engine valve timing system in which at least one camshaft is driven by means of a mechanism including a differential gear system which an permit a limited change in a phase relationship between an engine crankshaft and the at least one camshaft and in which the phase change takes the form of an angular displacement which is compliantly constrained about some nominal angle in such a way that a torque reaction from the camshaft operating valves results in a change in instantaneous phase displacement in some desired manner.

2. A system as claimed in claim 1 in which the differential gear mechanism has a reaction-member compliantly constrained from rotation.

3. A system as claimed in claim 2 in which the reaction-member is constrained by spring forces applied to the reaction-member through some suitable arrangement.

4. A system as claimed in claim 1 in which a means is provided for damping the phase change to limit the amplitude of the phase change in some desired manner.

5. A system as claimed in claim 4 in which the damping can be controlled in response to a signal such that the valve opening and closing times may be adjusted.

6. A system as claimed in claim 1 in which the phase change can be inhibited in response to a control signal.

7. A system as claimed in claim 2 in which a means is provided for damping the phase change to limit the amplitude of the phase change in some desired manner.

8. A system as claimed in claim 3 in which a means is provided for damping the phase change to limit the amplitude of the phase change in some desired manner.

9. A system as claimed in claim 2 in which the phase change can be inhibited in response to a control signal.

10. A system as claimed in claim 3 in which the phase change can be inhibited in response to a control signal.

11. A system as claimed in claim 4 in which the phase change can be inhibited in response to a control signal.

12. A valve timing system in an internal combustion engine, said engine having a crankshaft, at least one camshaft and valves associated with said at least one camshaft, said valve timing system comprising a differential gear system means, driven by said crankshaft, for compliantly driving said at least one camshaft in a phase relationship with said crankshaft, said differential gear system means including compliant means, responsive to torque variations from said camshaft, for providing a limited angular phase change from a nominal phase relationship between said crankshaft and said at least one camshaft.

13. A system as claimed in claim 12, wherein said differential gear system comprises an epicyclic differential gear system.

14. A system as claimed in claim 12, wherein the differential gear system means includes:

a rotational reaction-member for interconnecting said crankshaft and said at least one camshaft; and said compliant means is connected to said reaction-member and compliantly constrains said at least one camshaft and said crankshaft to said nominal phase relationship.

15. A system as claimed in claim 14, wherein said means for compliant means comprises at least one spring means for applying a restraining force to the reaction-member.

16. A system as claimed in claim 12, further including a means, responsive to said reaction-member, for damping and limiting amplitude of any phase change away from said nominal phase relationship.

17. A system as claimed in claim 16, further including means for adjusting damping of said damping and amplitude limiting means and thereby adjusting valve opening and closing times relative to position of said crankshaft.

18. A system as claimed in claim 12, further including controllable locking means, responsive to a control signal, for fixing said phase relationship to said nominal phase relationship.

* * * * *